US005080619A

United States Patent [19]

Uchida et al.

[11] Patent Number: 5,080,619

[45] Date of Patent: Jan. 14, 1992

[54] ENGINE CONTROL DEVICE

[75] Inventors: Tatsumi Uchida; Yoshikazu Hoshina; Azuma Sasabuchi; Kazuhisa Matsumoto, all of Yokohama, Japan

[73] Assignee: NHK Morse Co., Ltd., Yokohama, Japan

[21] Appl. No.: 661,558

[22] Filed: Feb. 26, 1991

[30] Foreign Application Priority Data

| | | | |
|---|---|---|---|
| Feb. 28, 1990 | [JP] | Japan | 2-47816 |
| Aug. 10, 1990 | [JP] | Japan | 2-213171 |
| Feb. 1, 1991 | [JP] | Japan | 3-12105 |

[51] Int. Cl.[5] ..... B63H 5/06

[52] U.S. Cl. ..... 440/84; 440/85; 440/86; 440/87

[58] Field of Search ..... 440/1, 84, 85, 86, 87

[56] References Cited

U.S. PATENT DOCUMENTS

| | | | |
|---|---|---|---|
| 4,753,618 | 6/1988 | Entringer | 440/84 |
| 4,801,282 | 1/1989 | Ogawa et al. | 440/84 |
| 4,810,216 | 3/1989 | Kawamura | 440/84 |
| 4,836,809 | 6/1989 | Pelligrino | 440/84 |
| 4,927,391 | 5/1990 | Bland et al. | 440/84 |

*Primary Examiner*—Jesus D. Sotelo

*Assistant Examiner*—Stephen P. Avila

*Attorney, Agent, or Firm*—Frishauf, Holtz, Goodman & Woodward

[57] ABSTRACT

Each of control boxes has an operation lever and an element moving together with the operation lever and a primary sensor for detecting the position of the moving element are arranged in each of the control boxes. A drive unit includes a motor, a movable rack driven by the motor and a secondary sensor for detecting the position of the moving rack. A control circuit serves to drive the motor to make any positional difference of the moving element and the movable rack zero. In a case where the position of the moving element does not coincide with that of the movable rack even after a predetermined time period goes by from when the rotation of the motor is started, current supply to the motor is temporarily stopped and then again started. When the control boxes are to be changed over from one to the other, this changeover is allowed only in a case where the control boxes which are to be changed over from one to the other and the drive unit are in neutral position. The drive unit includes a manual gear which can be toothed with the movable rack, and a handle for rotating the manual gear when something wrong happens to the electric system.

11 Claims, 16 Drawing Sheets

ENGINE CONTROL DEVICE

BACKGROUND OF THE INVENTION

1. Field of the Invention

The present invention relates to an engine control device suitable for remotely operating the controlled section of an engine, particularly the shift or throttle system of a marine engine.

2. Description of the Related Art

The conventional engine control device suitable for remotely operating the shift and throttle systems of the marine engine includes a remote control box provided with an operation lever and mechanical force transmitting members such as the push-pull cables for connecting the output end of the control box to the controlled sections of the engine. When the distance extending from the control box to the controlled section becomes long, therefore, the push-pull cable must become long, too. This causes large frictional resistance to be created at the time when the operation lever is operated, and the extent to which the cable is extended becomes large accordingly. Particularly in the case of the control device provided with plural control boxes, large frictional resistance is caused at the time when the operation lever is operated, thereby making it difficult to operate the device.

In order to solve this problem, we inventors of the present invention have developed an engine control device provided with an actuator which is started and stopped responsive to electric signals. In the case of this engine control device, the movement of the operation lever is converted to electric signal by means of a sensor. This signal is applied to a drive unit through an electric cable. A motor which serves as the actuator is housed in the drive unit and the controlled section of the engine is driven by the rotation force of the motor.

In a case where this electric engine control device is provided with plural remote control boxes, only one effective control box selected by a selection switch can control the engine. These control boxes can be changed over from one to the other by the selection switch, if necessary. When the control boxes are to be changed over from one to the other, however, it is dangerous from the viewpoint of safety that the control boxes are not in neutral but other position.

When the operation lever is moved or shifted to forward or reverse position in the electric engine control device, dog clutches of the shift system are moved in the direction of their becoming toothed with each other by the rotation force of the motor. The clutches are not toothed with each other sometimes in this case by one operation of the lever, and when current is kept supplied to the motor, the clutches are sometimes left not toothed with each other. When the motor is stopped by the electric system damaged, the engine is left uncontrollable. In order to measure this emergency, it is desirable to have a backup system which enables the engine to be manually controlled, if necessary.

SUMMARY OF THE INVENTION

The object of the present invention is therefore to provide an engine control device which has electrically-controlled drive units, and in which a plurality of control boxes can be switched from one to another, without any trouble and controlling an engine with safety and reliability.

This object of the present invention can be achieved by an engine control device for connecting a remote control box having an operation lever to a controlled section of an engine comprising a moving element associating with the operation lever; a primary sensor for creating electric signals in response to positions of the moving element; a force transmitting member having a drive and driven ends and the driven end being connected to the controlled section of the engine; a drive unit intended to drive the force transmitting member and including an electric motor rotatable forward and backward, a worm gear system driven by the motor and provided with a drive gear, a movable rack connected to the drive end of the force transmitting member and driven by the drive gear, and a secondary sensor for creating electric signals in response to positions of the movable rack; and a control circuit for controlling the motors to be started and stopped and serving to compare the position of the moving element detected by the primary sensor with that of the movable rack detected by the secondary sensor to drive the motor in such a direction as to eliminate a mutual displacement of these two components.

When a selection switch is operated to change over the control box, this changeover is allowed by the control circuit only in a case where both of the control box which has been under operation mode and of the control box which will be put into operation mode are in neutral position and where a movable rack in the drive unit is also in neutral position.

The movable rack is toothed with a drive gear in the drive unit under usual operation mode. The rotation force of the motor is transmitted to the movable rack through the drive gear in this case.

When the motor is made inoperative because the electric system is damaged or so, the operator moves the movable rack to a second position. This causes the movable rack to be released from the drive gear but toothed with a manual gear.

The engine control device of the present invention can be applied to industrial vehicles and remote control systems for construction purposes as well as marine engines.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
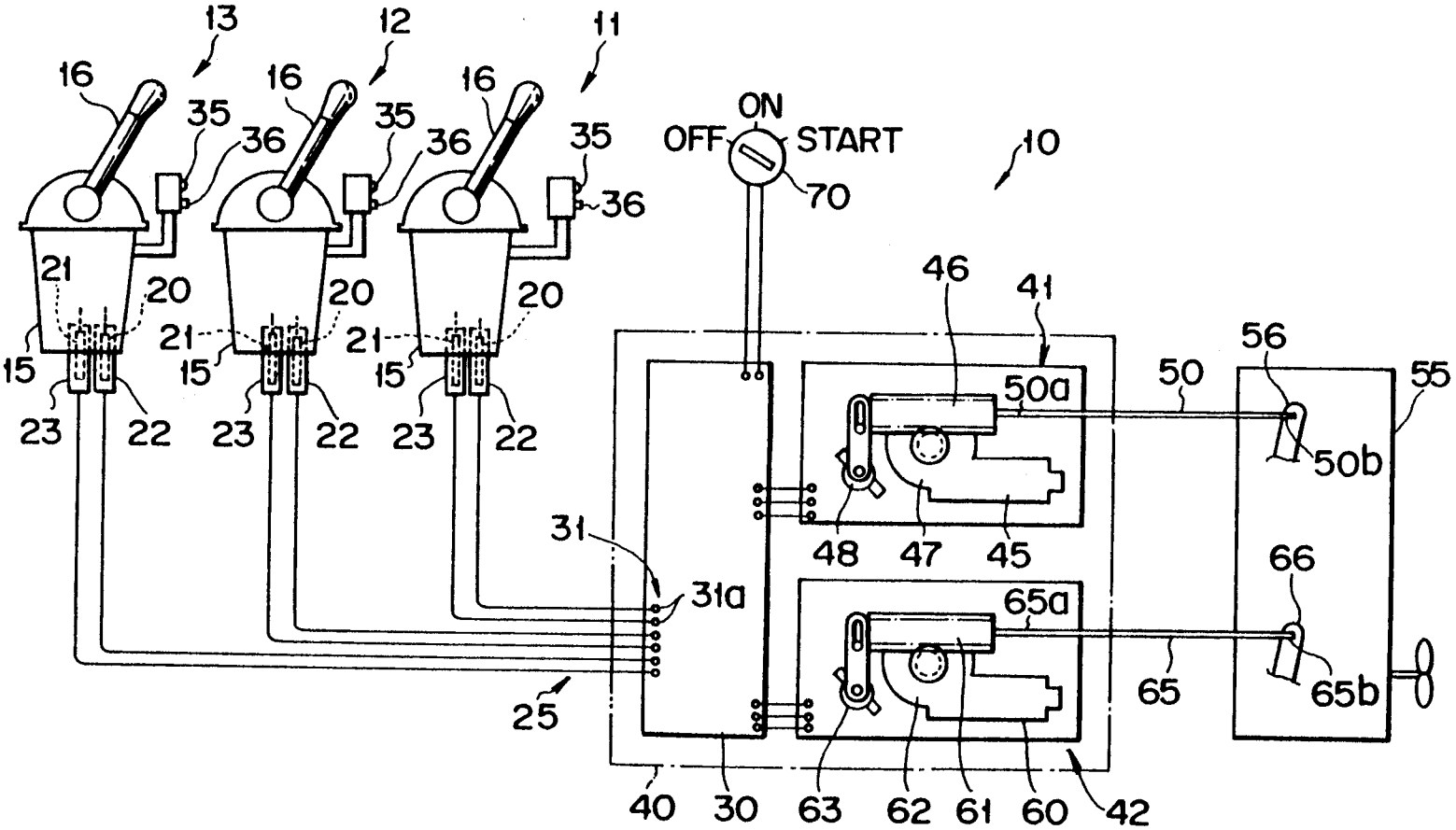
FIG. 1 shows control box and circuit used in an embodiment of the engine control device according to the present invention.

An embodiment of the present invention will be described referring to FIGS. 1 through 13. A control device 10 for use with the marine engine shown in FIG. 1 includes plural remote control boxes 11, 12 and 13. The control boxes 11, 12 and 13 are located adjacent to the pilot seat in the cabin, at the flying bridge and the others of the marine boat.

Each of the control boxes 11, 12 and 13 includes a housing 15, an operation lever 16 attached to the housing 15, shift and throttle elements 20 and 21 associating with the movement of the operation lever 16, and primary sensors 22 and 23 for detecting positions of these elements 20 and 21. The shift sensor 22 sends electric signal to a control circuit 30 responsive to the position of the shift element 20. The throttle sensor 23 sends electric signal to the control circuit 30 responsive to the position of the throttle element 21. The sensors 22 and 23 are potentiometers, for example.

The elements 20, 21 and the sensors 22, 23 may be located independently of the housing 15. One of microswitches 200-203 shown in FIG. 20, for example, may be used as the shift sensor 22 instead of the potentiometer.

The sensors 22 and 23 are connected to external connecting terminals 31 of the control circuit 30 through electric cables 25. The terminals 31 shown are designed in such a way that those terminals 31*a* of them which are connected to the first control box 11 are preferentially made under operation mode when power is applied to the control circuit 30.

Each of the control boxes 11, 12 and 13 is provided with a display lamp 35 and a control box changeover selection switch 36, which are connected to the control circuit 30. The lamp 35 and the switch 36 may be attached to the housing 15 or positioned independently of the housing 15.

In the case of the control boxes 11, 12 and 13 of the single-lever type shown, shift and throttle control signals are applied from the sensors 22 and 23 to the control circuit 30 responsive to angles at which the operation lever 16 is operated. When the operation lever 16 is leaned forward from neutral position by a certain angle, signal which represents that shift is made to forward position is applied from the sensor 22 to the control circuit 30. When the operation lever 16 is further leaned forward from the forward position, throttle control signal is applied from the sensor 23 to the control circuit 30 responsive to the angle at which the operation lever 16 has been leaned forward.

When the operation lever 16 is leaned backward from the neutral position by a certain angle, signal representing that shift is made to reverse position is applied from the sensor 22 to the control circuit 30. When the lever 16 is further leaned backward from the reverse position, throttle control signal is applied from the sensor 23 to the control circuit 30 in response to the angle at which the lever 16 has been leaned backward. As seen in the case of the control box of the well-known twin-lever type, the shift operation lever may be arranged independently of the throttle operation lever.

Figure 21:
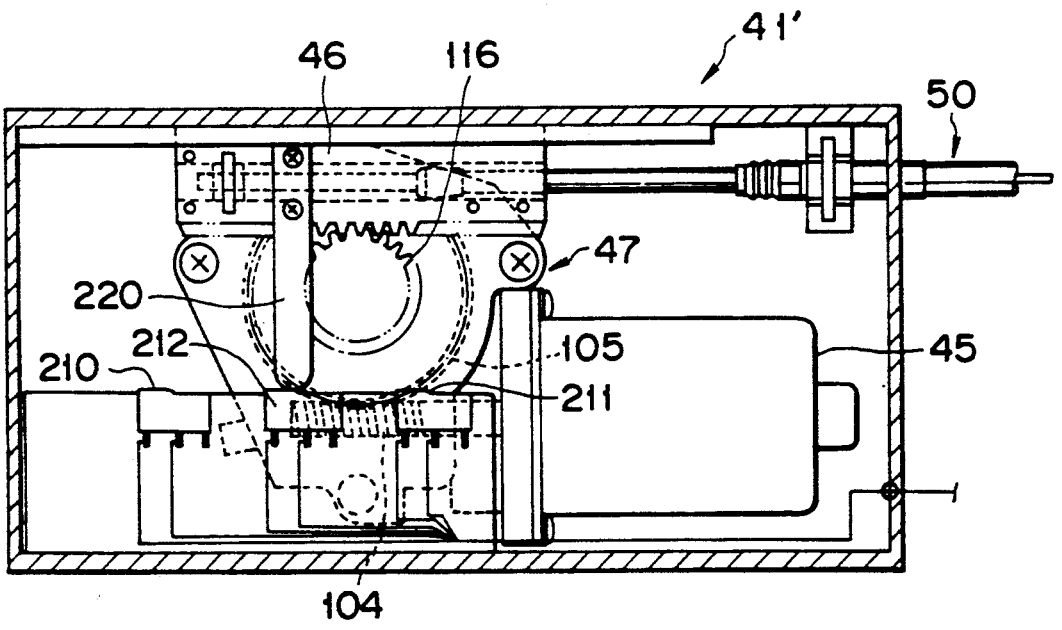
FIG. 21 is a front view showing a variation of the secondary sensor in the drive unit.

Shift and throttle drive units 41 and 42 are housed in a case 40. The shift drive unit 41 comprises a DC motor (or DC electric motor) 45 which serves as a drive source, a movable rack 46 which is an example of the driven member, a worm gear system 47 for transmitting the rotation force of the motor 45 to the rack 46, and a secondary sensor 48 for detecting the position of the rack 46. A potentiometer of the rotary type is used as an example of the secondary sensor 48. One of microswitches 210-212 shown in FIG. 21 may be used instead of the potentiometer.

A drive end 50*a* of a push-pull cable 50 which is used as an example of the force transmitting member is connected to the rack 46. A driven end 50*b* of the push-pull cable 5*a* is connected to a shift operation end 56 of an engine 55 which is an example of the controlled component. When the rack 46 travels forward or backward at a certain stroke, therefore, the engine 55 is shifted to forward or backward position, depending upon the direction in which the rack 46 travels.

The throttle drive unit 42 includes a DC motor 60 which serves as s drive source, a movable rack 61 which is an example of the driven member, a worm gear system 62 for transmitting the rotation force of the motor 60 to the rack 61, and a secondary sensor 63 for detecting the position of the rack 61. A drive end 65*a* of a push-pull cable 65 is connected to the rack 61, while a driven end 65*b* thereof to a throttle operation end 66 of the engine 55. Therefore, the throttle system of the engine 55 moves from idling position to accelerating or decelerating direction, depending upon the direction and amount of the rack 61 traveled.

Figure 2:
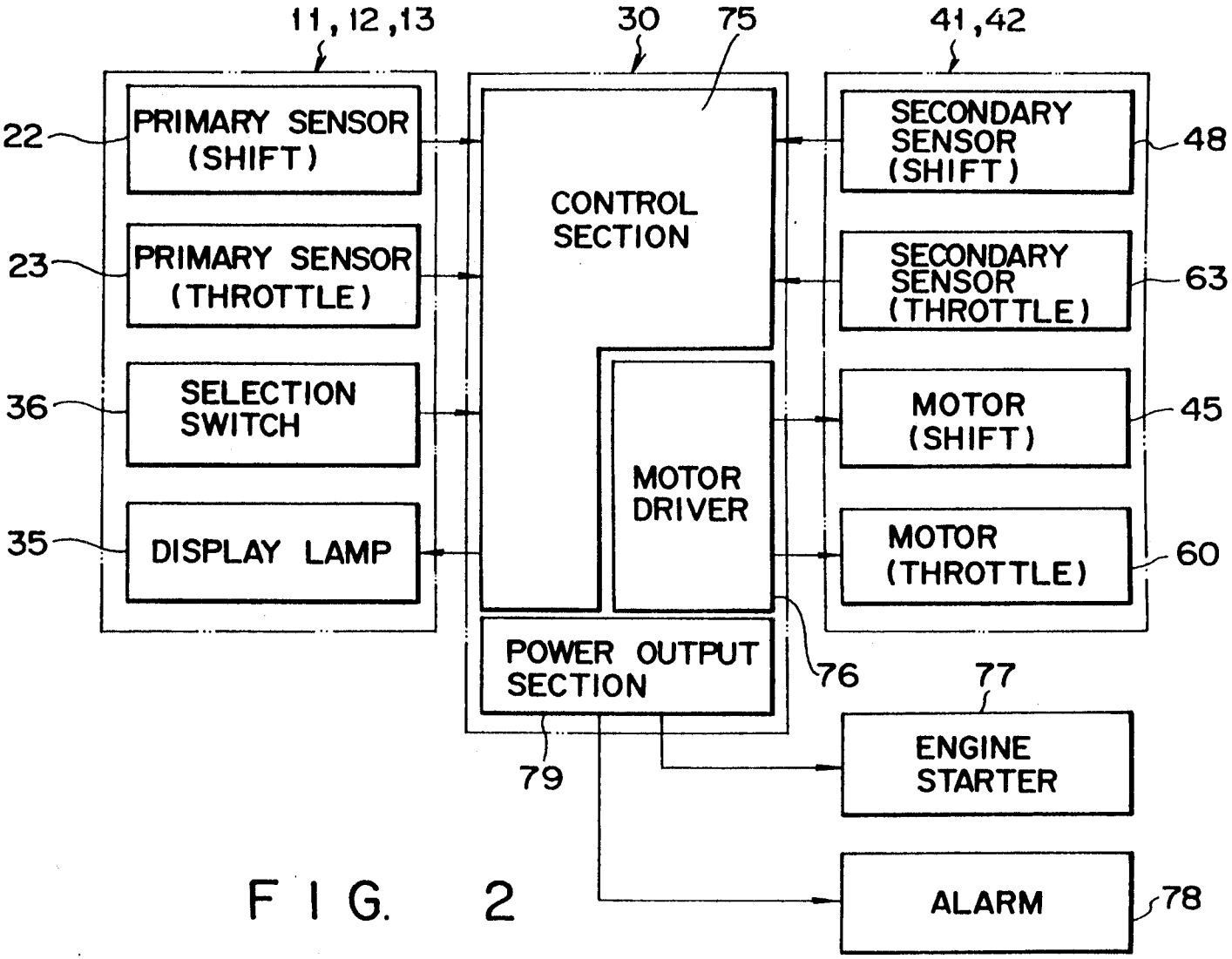
FIG. 2 is a block diagram showing a control system of the engine control device shown in FIG. 1.

The control circuit 30 is a digital one including a micro-computer. Current is applied to the circuit 30 when a main switch 70 is turned on. As shown in FIG. 2, the control circuit 30 includes a control section 75 to which the sensors 22, 23, 48, 63, the lamp 35 and the switch 36 are connected, a motor driver 76 to which the motors 45 and 60 are connected, and a power output section 79 to which an engine starter 77 and an alarm 78 are connected. The alarm 78 is a lamp, buzzer or others.

A control program incorporated into the control section 75 will be described referring to FIGS. 3 through 6. A main program is summed up in FIG. 3.

1) Changeover of Control Boxes

When the main switch 70 is turned from off-state to on-state or the system is started, the first control box 11 has the priority of its being brought under operation mode. And it is programmed that changeover is made to the other control boxes 12 and 13 when the following requisites are satisfied.

Figure 3:
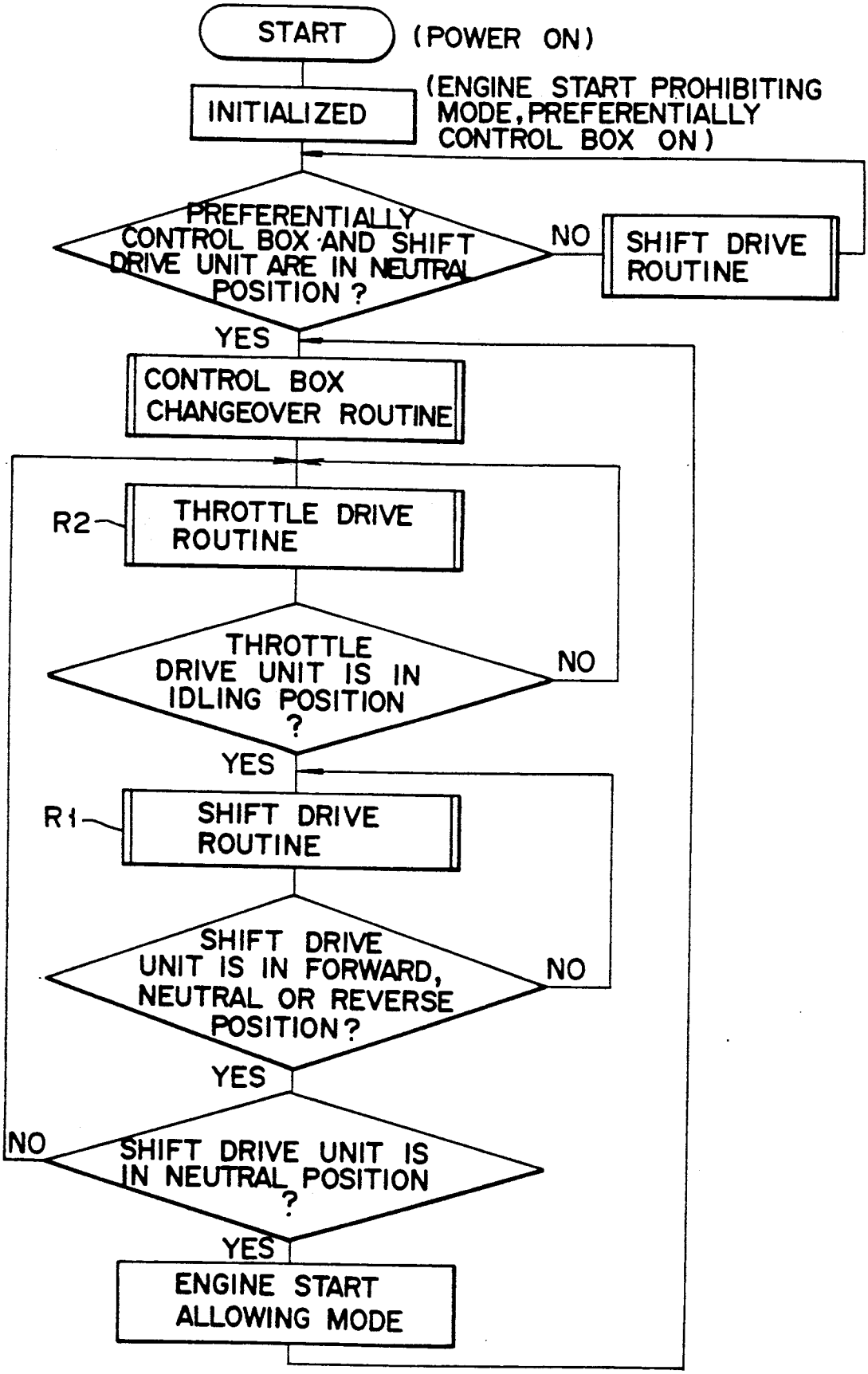
FIG. 3 is a flow chart showing an example of the control program for the engine control device shown in FIG. 1.
Figure 4:
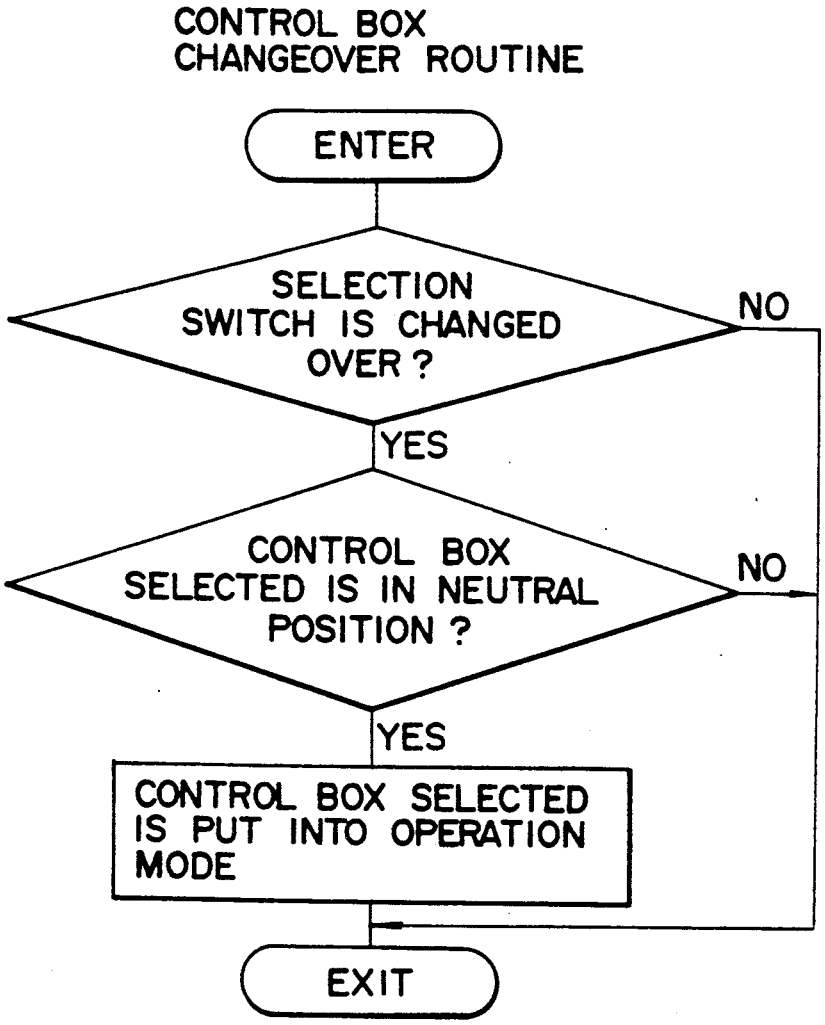
FIG. 4 is a flow chart showing a control box changeover routine in the control program shown in FIG. 3.

As shown in FIGS. 3 and 4, changeover to the control boxes 12 and 13 is allowed when the following requisites are met. Namely, this changeover is allowed if the operation lever 16 of the control box which has been under operation mode (or of the first control box 11 at the time when the system is started) and the rack 46 in the drive unit 41 are both in neutral position and if the operation lever 16 of the control box which is to be changed over (or of the control box 12 or 13 at the time when the system is started) is also in neutral position when the selection switch 36 is turned on.

Figure 5:
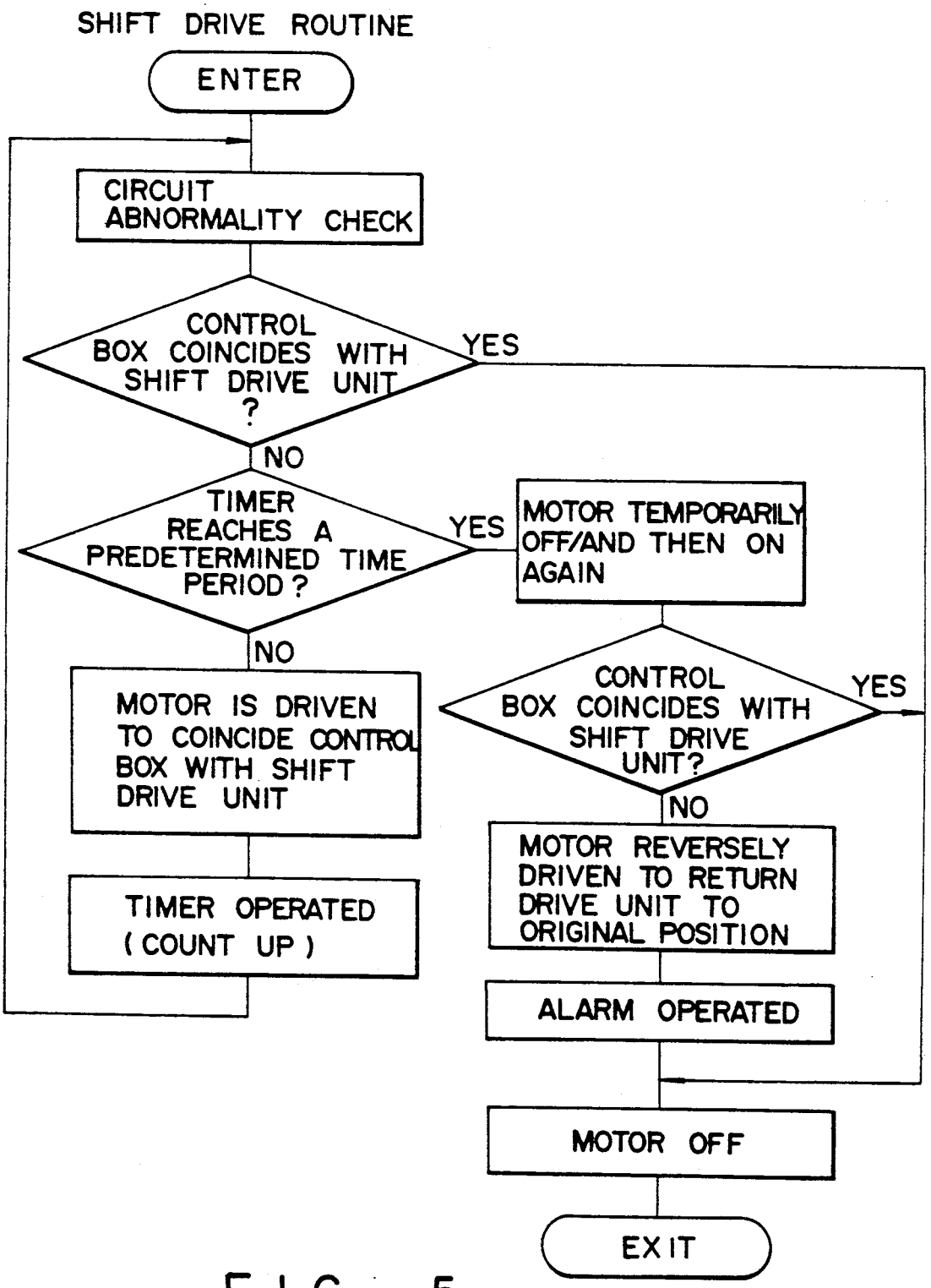
FIG. 5 is a flow chart showing a shift drive routine in the control program shown in FIG. 3.

When the operation lever 16 is not in the neutral position but it is returned there by the operator, a shift drive routine shown in FIG. 5 is executed and the rack 46 in the drive unit 41 is returned to the neutral position, thereby enabling changeover to the other control box to be made ready.

2) Engine Start

When the engine is to be started, the operator switches on the main switch 70 and turns it to a position where the engine starter is ignited. It is programmed that a mode under which the ignition of the starter 77 is prohibited is created when the main switch 70 is changed over from off-state to on-state. When the following requisite is satisfied, an output relay connected in series to the current supply terminal of the starter 77 is closed to create a mode under which the ignition of the starter 77 is allowed.

The requisite under which the ignition of the starter 77 is allowed is that the operation lever 16 of the control box which is under operation mode is in neutral position as well as the rack 46 in the shift drive unit 41. Therefore, the operation lever 16 must be returned to the neutral position to ignite the starter 77 when the operation lever 16 is not in the neutral position. When the operation lever 16 is returned to the neutral position, the shift drive routine shown in FIG. 5 is executed and the rack 46 in the drive unit 41 is returned to the neutral position.

3) Shift Operation

When the engine is started and the operation lever 16 of the control box which is under operation mode is then moved from the neutral position to forward or reverse position, the shift element 20 moves to forward or reverse position. This creates a difference between the position of the shift element 20 and that of the rack 46 in the shift drive unit 41. This positional difference is detected by the primary and secondary sensors 22 and 48. When the motor 45 is rotated in such a direction that makes the positional difference zero, the shift rack 46 is moved to shift the engine 55 to the forward or reverse position. When the operation lever 16 is returned to the neutral position, the motor 45 is reversely rotated to return the rack 46 to the neutral position.

A timer is used in the shift drive routine shown in FIG. 5 to count time lapsing from when the rotation of the motor 45 is started. In a case where the position of the element 20 does not coincide with that of the rack 46 even after a certain time period lapses from when the rotation of the motor 45 is started, current supply is temporarily stopped and then again supply to the motor 45. When this retrying operation is executed after the lapse of an instant (or 0.2 seconds, for example), gears which have not been engaged with each other by one operation in the shift system in which a dog clutch is housed can be engaged with each other.

In a case where the position of the element 20 does not coincide with that of the rack 46 even when the retrying operation is executed, the rack 46 is returned to its original position (or position at which both of the element 20 and the rack 46 coincide with each other) and the alarm 78 is made operative. If the rack 46 cannot be returned to its original position by some cause in this case, current supply to the motor 45 is automatically stopped after the lapse of a certain time period. When the retrying operation is changed to the alarm operation just after the main switch 70 is turned on (or the system is started), the rack 46 is returned to the neutral position.

The operation lever 16 is sometimes quickly moved from forward to reverse via neutral position or vice versa at a large stroke to suddenly stop the marine boat. Time during which current must be supplied to the motor 45 becomes about 2 times in this case as compared with the usual shift operation (from neutral to forward or from neutral to reverse). In this case, therefore, the above-mentioned timer is reset not to count a predetermined time. In order to let the timer have this reset function, the above-described retrying operation is not executed when quick shift is made from forward to reverse or vice versa.

4) Throttle Operation

When the operation lever 16 of the control box which is under operation mode is moved in a range of throttle operation, a difference is created between the position of the element 21 and that of the rack 61 in the throttle drive unit 42 and the motor 60 is thus rotated in such a direction that makes both of them coincide with each other. When the rack 61 moves responsive to the angle at which the operation lever 16 is operated, therefore, the throttle system of the engine 55 can be controlled.

Figure 6:
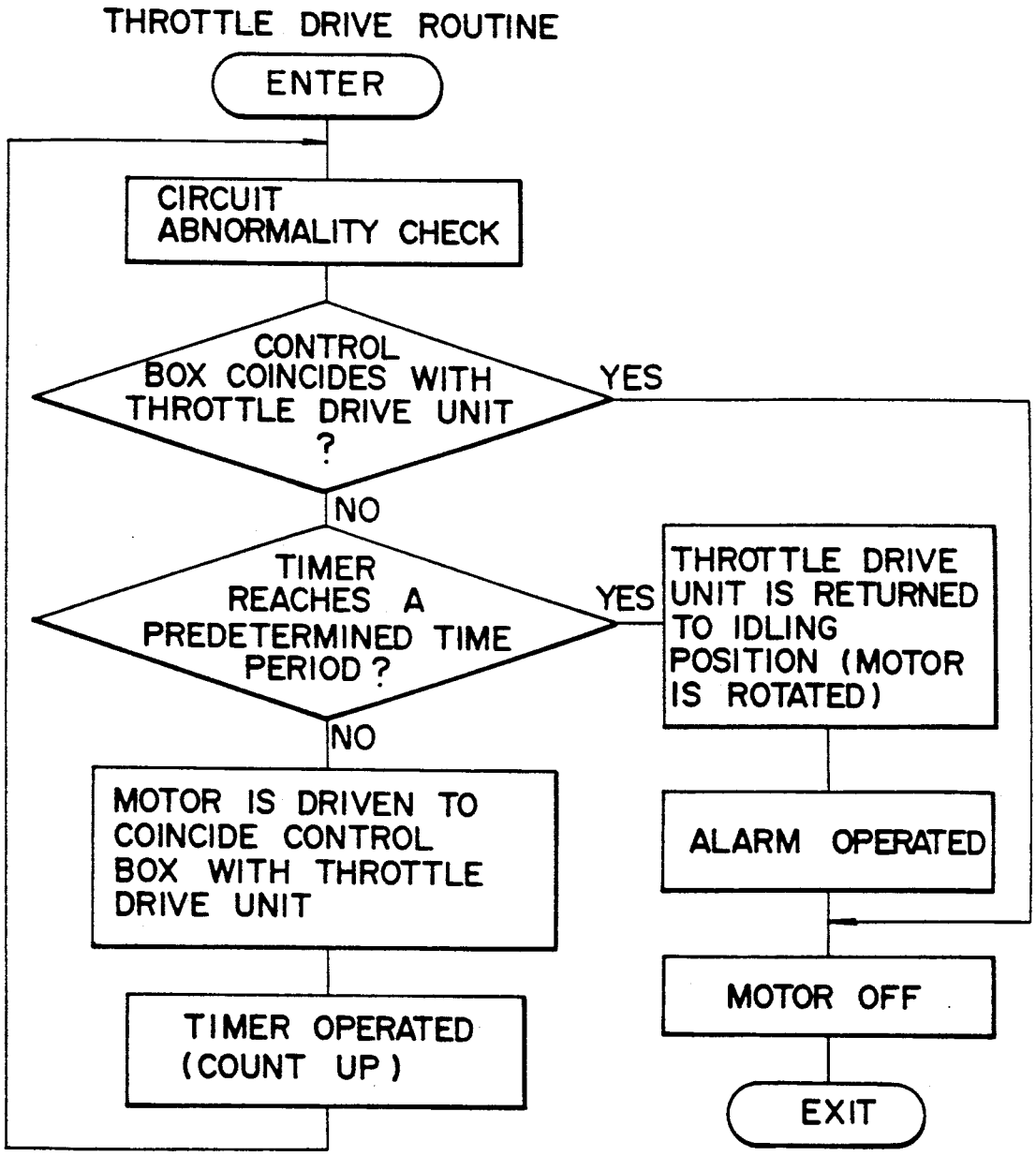
FIG. 6 is a flow chart showing a throttle drive routine in the control program shown in FIG. 3.

A timer is used in a throttle drive routine shown in FIG. 6 to count the time lapsing from when the rotation of the motor 60 is started. When the position of the element 21 does not coincide with that of the rack 61 even after a certain time period lapses from when the rotation of the motor 60 is started, the motor 60 is rotated in such a direction that returns the rack 61 to idling position in the throttle drive unit 42, and the alarm 78 is made operative.

5) Other Functions

As shown in FIG. 3, it is arranged that the shift and throttle drive routines R1 and R2 are alternately executed according to circumstances or only one of them is continuously executed. After the throttle drive routine R2 is executed, changeover to the shift drive routine R1 can be made only when the throttle drive unit 42 is in the idling position. Shift operation can be therefore made only when the throttle is idling.

After the shift drive routine R1 is executed, changeover to the throttle drive routine R2 can be made only when the shift drive unit 41 is in one of forward, neutral and reverse positions. Only when shift is completely made to either of the forward, neutral or reverse position, therefore, throttle operation can be executed. This enables changeover to each of the control boxes 11, 12 and 13 to be made under safe condition.

When the electric cables 25 are broken or short-circuited, abnormal control current flows through them. When this abnormal current is detected by the control circuit 30, the motor 45 is automatically rotated to return the rack 46 to the neutral position in the shift drive unit 41, while the motor 60 is automatically rotated to return the rack 61 to the idling position in the throttle drive unit 42. The program designed in this manner can further enhance safety.

The shift drive unit 41 will be described in detail referring to FIGS. 7 through 13. The shift drive unit 41 is common in fundamental structure to the throttle drive unit 42.

Figure 9:
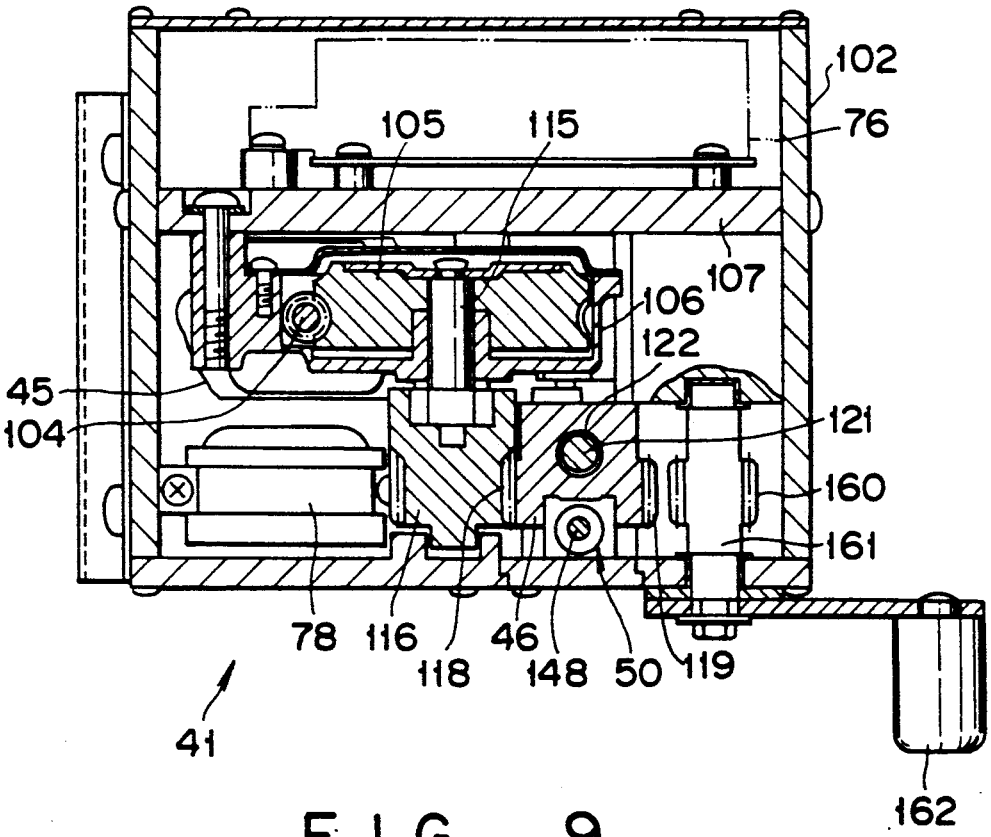
FIG. 9 is a sectional view taken along a line IX—IX in FIG. 7.

The drive unit 41 has the motor 45 in a water-tight housing 102. A worm 104 is attached to the output shaft of the motor 45. The worm 104 is toothed with a worm wheel 105. The worm 104 and the worm wheel 105 are housed in a gear case 106. As shown in FIG. 9, the gear case 106 is fixed to a partition plate 107. The motor driver 76 is attached to the partition plate 107. The housing 102 is provided with the buzzer 78. A drive gear 116 is attached to a shaft 115 of the worm wheel 105. The drive gear 116 is toothed with the rack 46. The rack 46 has a first teeth section 118 and a second teeth section 119 on both sides thereof. The first teeth section 118 of the rack 46 is toothed with the drive gear 116.

The rack 46 is held, freely movable in its axial direction, by a rod-like guide member 121. More specifically, the rack 46 is provided with a through-hole 122 extending along the center axial line of the rack 46 and the guide member 121 is inserted into the through-hole 122 of the rack 46 in such a way that the guide member 121 and the rack 46 can freely move relative to each other. A base 123 of the guide member 121 is supported, freely rockable, by a pin 125 in a bracket 124 attached to the housing 102. The guide member 121 can rock in a range of angle $\theta$ in FIG. 7, taking the pin 125 as its center. Therefore, the rack 46 can move from a first position where its first teeth section 118 is toothed with the drive gear 116 to a second position in FIG. 13 where its first teeth section 118 is separated from the drive gear 116.

A rack position changeover system 130 is located adjacent to a free end 126 of the guide member 121. The rack position changeover system 130 shown has a knob 131. The guide member 121 is inserted, freely movable along its axial line, into a through-hole 132 which passes through the knob 131 along the center axial line thereof. A projection 133 is projected from one end face of the knob 131 and fitted into a hole 135 of the housing 102.

Figure 10:
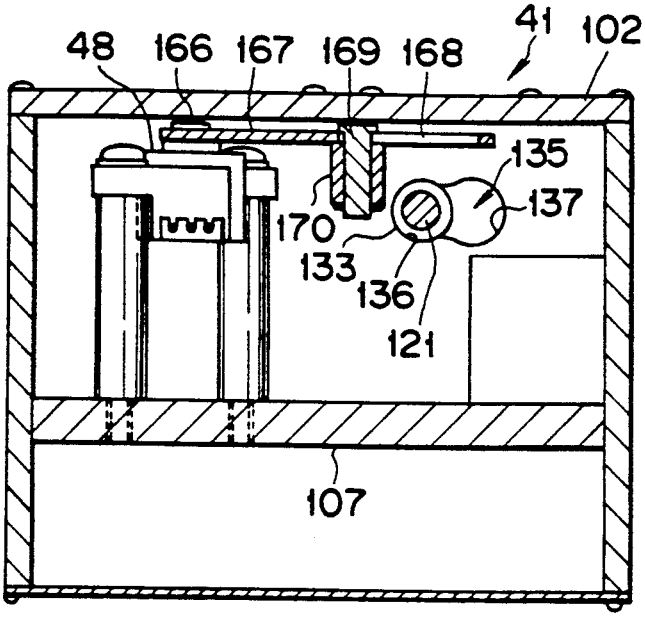
FIG. 10 is a sectional view taken along a line X—X in FIG. 7.

As shown in FIG. 10, the hole 135 has first and second portions 136 and 137 and the projection 133 of the knob 131 is selectively fitted into either of the portions 136 and 137 of the hole 135. When the projection 133 is fitted into the first portion 136 of the hole 135, the rack 46 and the guide member 121 are held at the above-mentioned first position. When it is fitted into the second portion 137 of the hole 135, the rack 45 and the guide member 121 are held at the abovementioned second position.

A compression spring 139 is fitted onto the guide member 121 between a spring seat 138 of the guide member 121 and the knob 131, which is urged by the spring 139.

Figure 11:
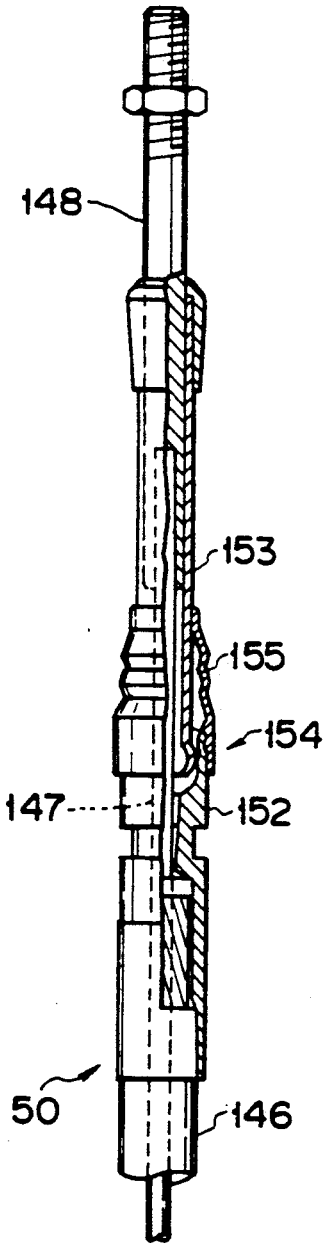
FIG. 11 is a side view showing a push-pull cable partly sectioned.

The push-pull cable 50 includes an outer tube 146 and a core 147 inserted into the tube 146 to freely move in the axial direction of the tube 146, as shown in FIG. 11. A rod 148 is fixed to the front end of the core 147 and a hub 152 is fixed to the front end of the outer tube 146. A sleeve 153 is connected to the front end of the hub 152.

The hub 152 is connected to the sleeve 153 at a portion 154 which serves as a joint for allowing the sleeve 153 to be rocked in an angle range. The pin 125 is located adjacent to this joint portion 154. The guide member 121 and the sleeve 153 can rock in the range of angle $\theta$ (see FIG. 7). A cover 155 is attached to the joint portion 154. The hub 152 is fixed to a cable support 157 of the housing 102. The rod 148 is projected outside the sleeve 153. The front end of the rod 148 is fixed to the rack 46 by a coupling member 158.

Figure 7:
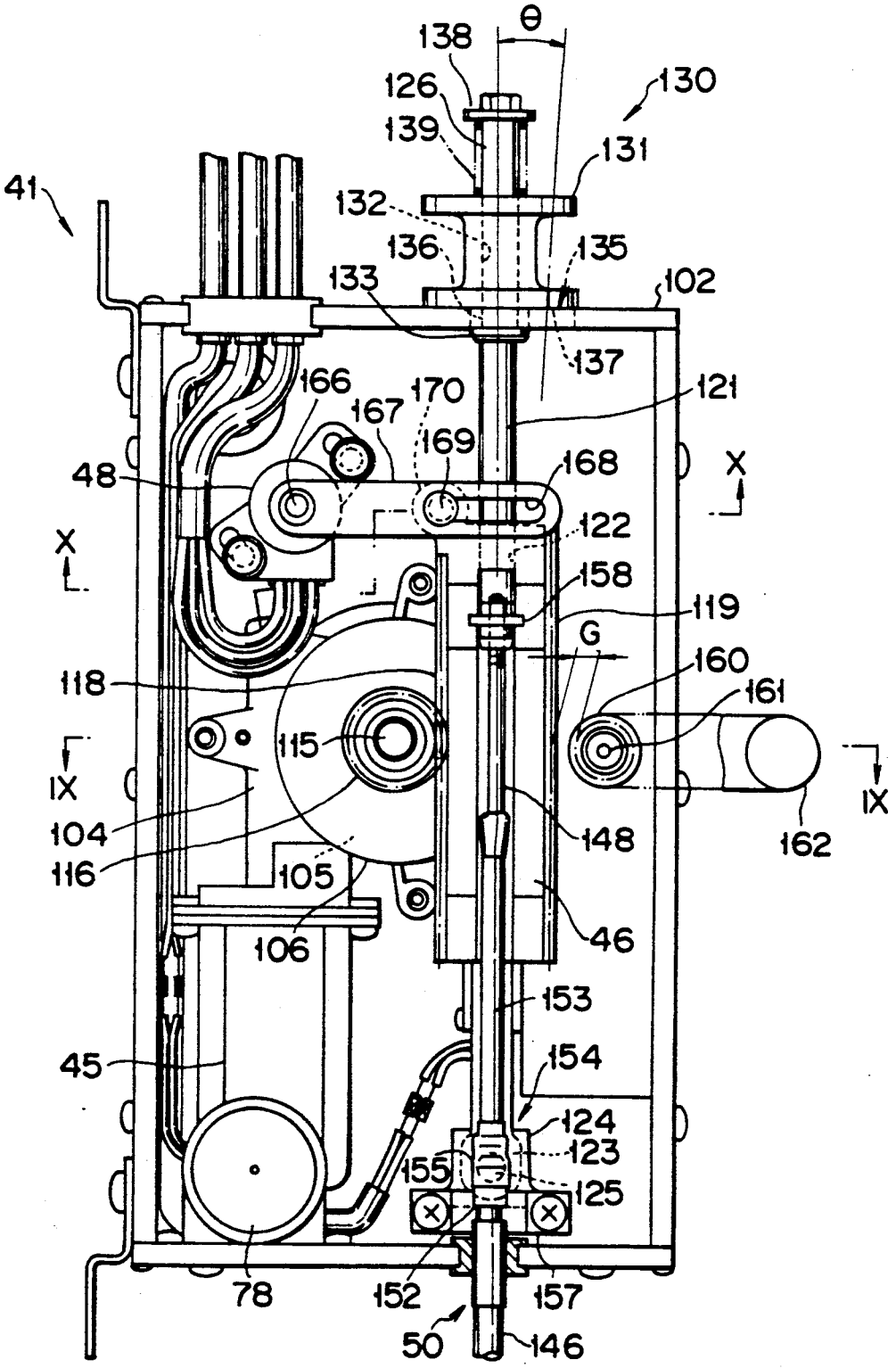
FIG. 7 is a front view showing a shift drive unit.
Figure 13:
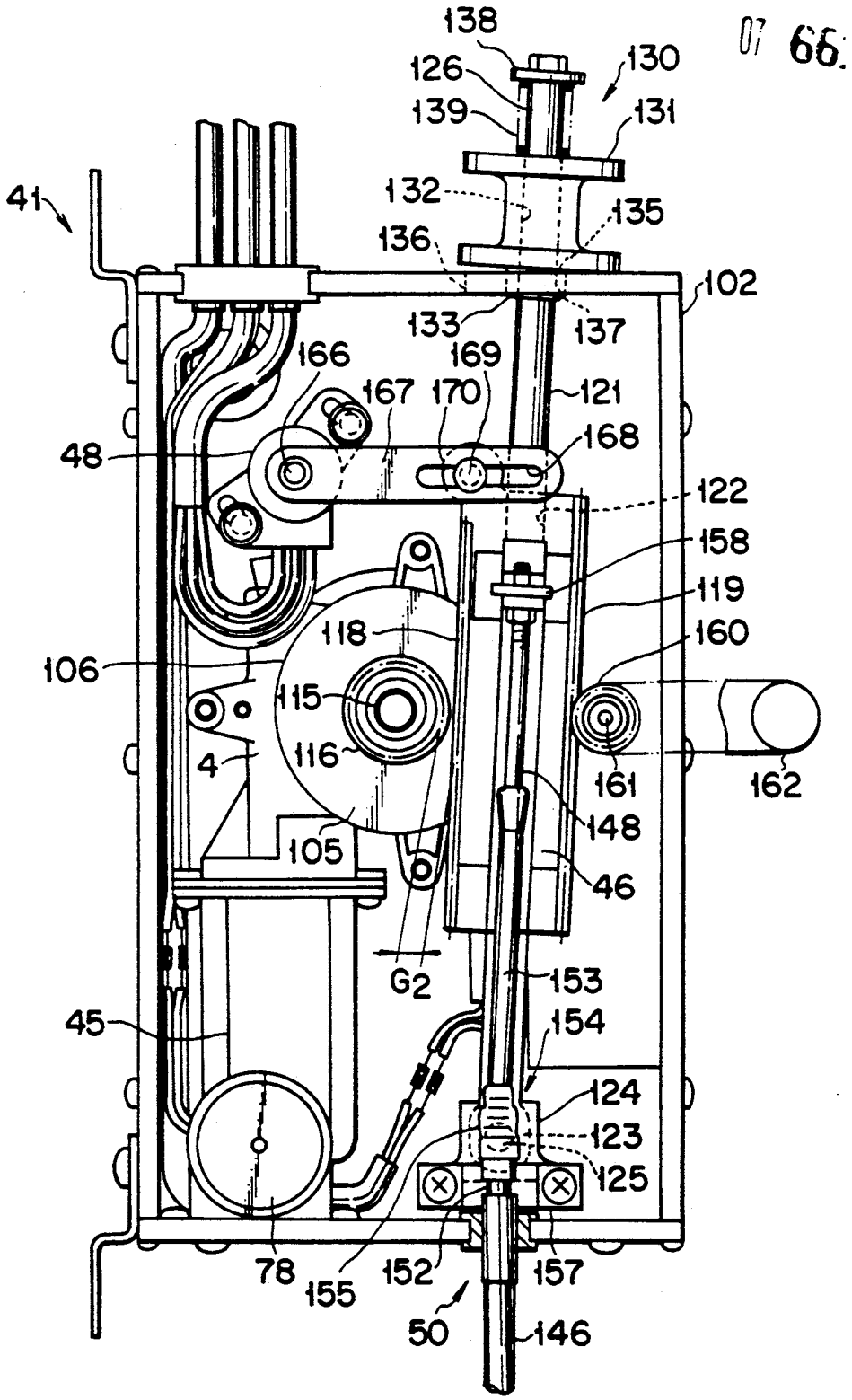
FIG. 13 is a front view showing the movable rack moved to a second position in the drive unit shown in FIG. 7.

A manual gear 160 is located opposing to the second teeth section 119 of the rack 46. When the rack 46 is at the first position, the manual gear 160 is separated from the first teeth section 118 only by a distance G, as shown in FIG. 7. When the rack 46 moves to the second position, the second teeth section 119 is toothed with the manual gear 160, as shown in FIG. 13. A handle 162 is attached to a shaft 161 of the manual gear 160, locating outside the housing 102.

The secondary sensor 48 for detecting the position of the movable rack 46 in the axial direction thereof is a potentiometer of the rotary type. This potentiometer 48 includes a shaft 166 and an arm 167 attached to the shaft 166. The arm 167 is provided with a slot 168 into which a pin 169 is fitted. The pin 169 is attached to a pin holder 170 of the rack 46.

Figure 8:
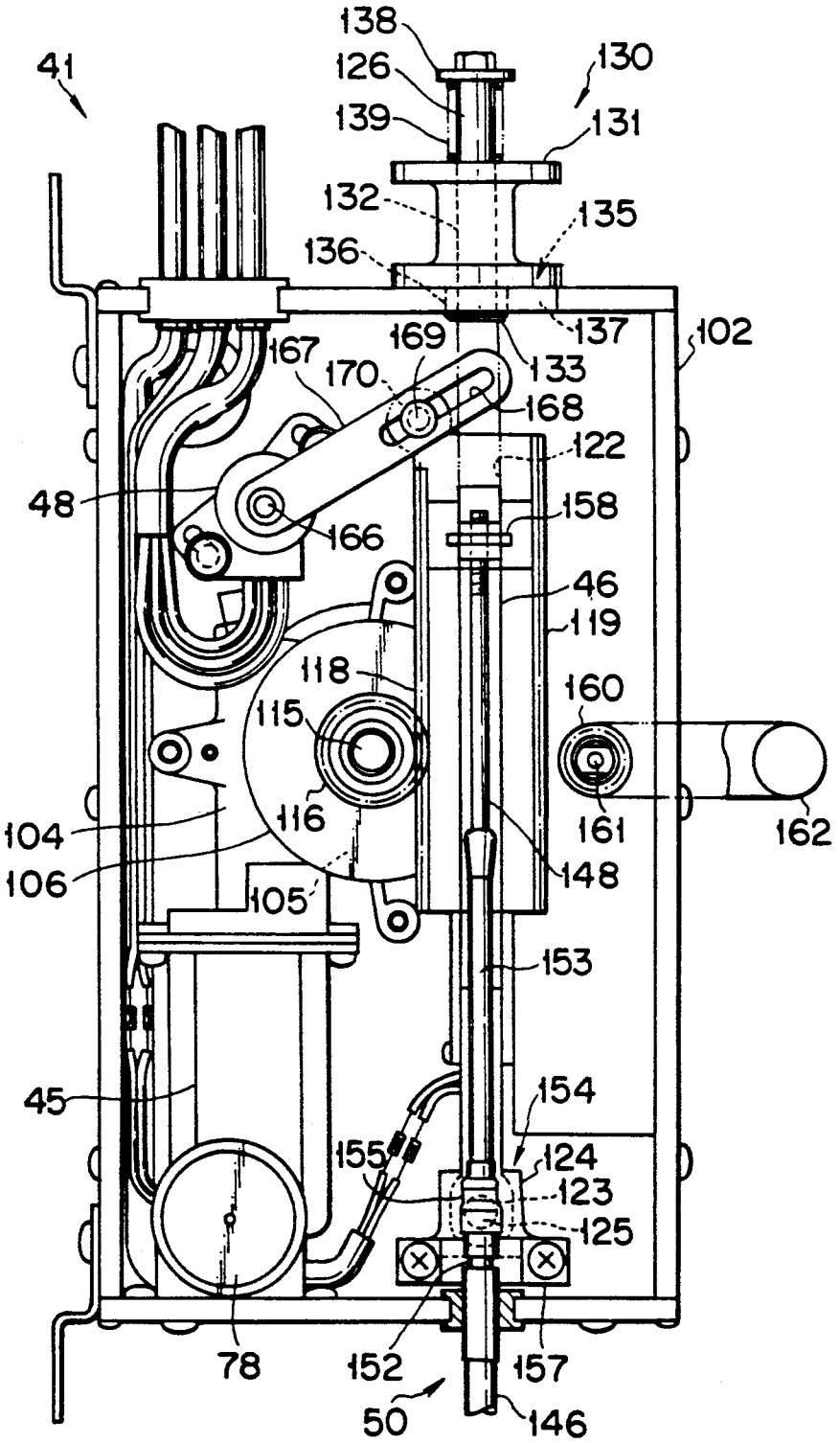
FIG. 8 is a front view showing a movable rack moved in the axial direction of the drive unit shown in FIG. 7.

The operation of the drive unit 41 will be described. When the rack 46 is at the first position, the drive gear 116 is toothed with the first teeth section 118 of the rack 46, as shown in FIG. 7. When the motor 45 is rotated under this state, the rack 46 is moved in the axial direction of the guide member 121 by the rotation of the drive gear 116. When the drive gear 116 rotates anticlockwise, for example, the rack 46 is moved as shown in FIG. 8. When the rack 46 reaches a predetermined position, the motor 45 is stopped responsive to signal applied from the potentiometer 48.

Figure 12:
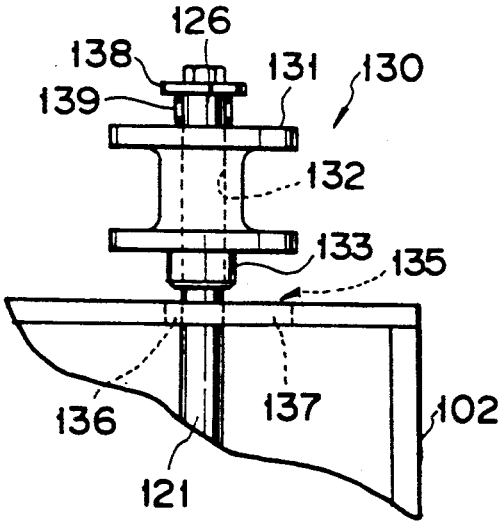
FIG. 12 is a front view showing how a knob of the drive unit shown in FIG. 7 is operated.

When the motor 45 is stopped by some electric cause. The operator pulls the knob 131 to disengage the projection 133 from the hole 135, as shown in FIG. 12, and then pushes the knob 131 to fit the projection 133 into the second portion 137 of the hole 135, as shown in FIG. 13. The guide member 121 is thus tilted at the pin 125 by the angle $\theta$ to thereby cause the second teeth section 119 of the rack 46 to be toothed with the manual gear 160. When the handle 162 is rotated, therefore, the rack 46 can be moved in any desired direction. In addition, the drive gear 116 is released from the rack 46 in this case and this also makes it easy to move the rack 46 in any desired direction.

Figure 14:
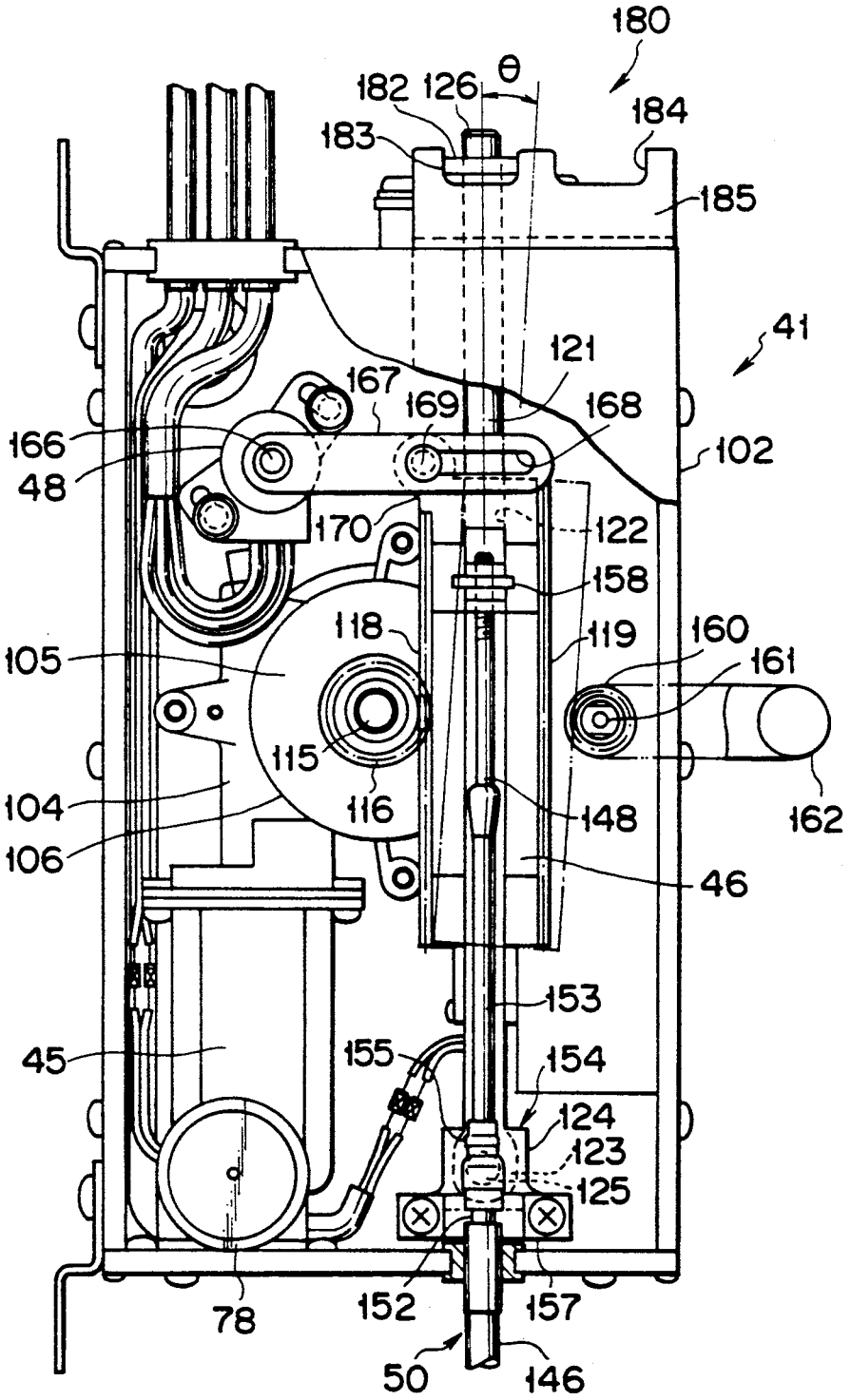
FIG. 14 is a front view showing another embodiment of the drive unit.
Figure 15:
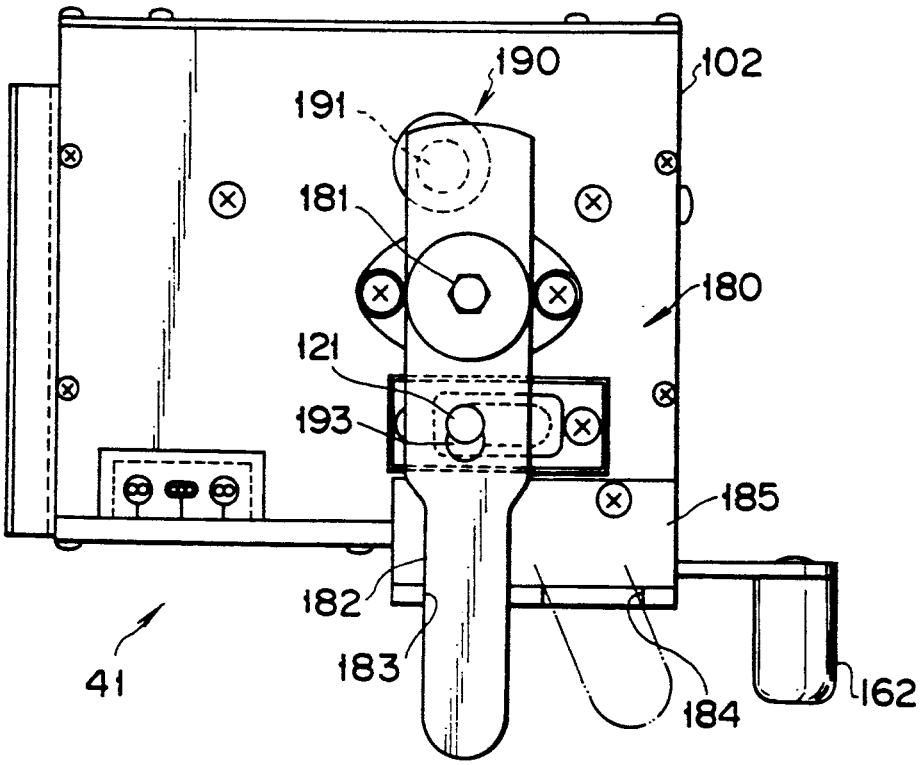
FIG. 15 is a plan showing the drive unit in FIG. 14.
Figure 16:
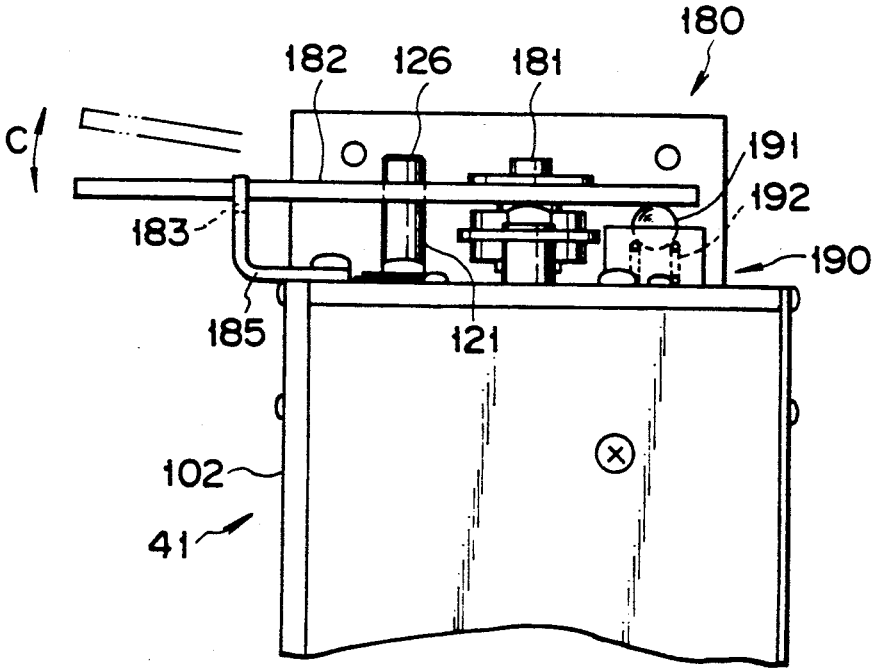
FIG. 16 is a side view showing a part of the drive unit in FIG. 14.

A rack position changeover system 180 shown in FIGS. 14 through 16 may be used instead of the above-described one 130. The system 180 has a changeover lever 182 swingable round a shaft 181. The changeover lever 182 can be selectively engaged with one of first and second recesses 183 and 184 of a holder 185. The changeover lever 182 can also rock to some extend in directions C in FIG. 16. The holder 185 is fixed to the housing 102.

The changeover lever 182 is urged by an urging system 190 to fit into the recess 183 or 184. The urging system 190 shown includes a pressing element 191 such as the steel ball, and a compression spring 192 for urging the pressing element 191 against the changeover lever 182.

The changeover lever 182 is provided with a slot 193 at the center portion thereof in the longitudinal direction thereof. The guide member 121 is passed through the slot 193 of the changeover lever 182. When the changeover lever 182 is fitted in the first recess 183, the first teeth section 118 of the rack 46 is toothed with the drive gear 116, as shown in FIG. 14. When the changeover lever 182 is fitted in the second recess 184, the first teeth section 118 of the rack 46 is released from the drive gear 116 while the second teeth section 119 thereof is toothed with the manual gear 160.

It is not necessarily needed that the guide member 121 is shaped like a rod. It may be a rail member having a guide face slidably contacted with the outer face of the rack 46, or it may be a plate-like guide member. A force transmitting member such as the rod and the link may be connected to the rack 46.

Figure 17:
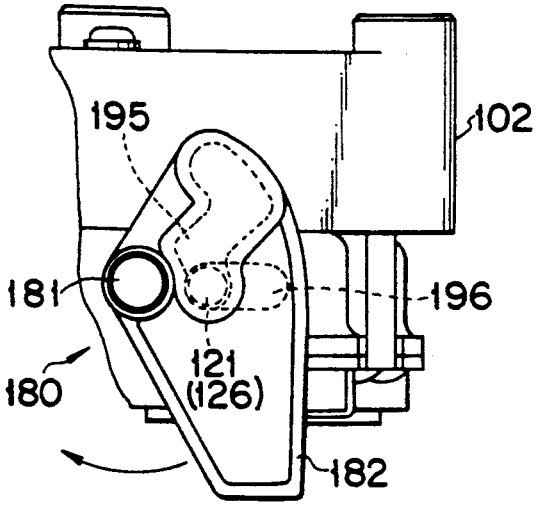
FIG. 17 is a plan showing a variation of the rack position changeover system.
Figure 18:
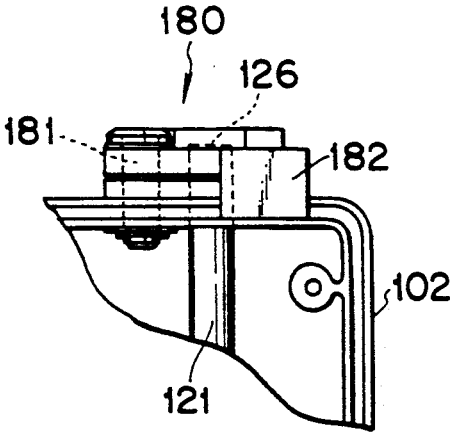
FIG. 18 is a front view showing the rack position changeover system in FIG. 17.
Figure 19:
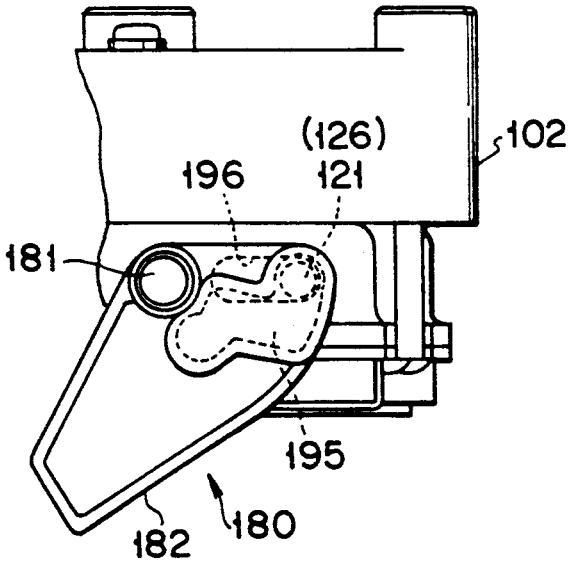
FIG. 19 is a plan showing a changeover lever operated in the case of the rack position changeover system shown in FIG. 17.

A variation of the rack position changeover system 180 is shown in FIGS. 17 through 19. The lever 182 is provided with a cam groove 195 in this case. The guide member 121 can move along a slot 196 of the housing 102. A free end 126 of the guide member 121 is fitted into the cam groove 195. The arrangement of other components is substantially same as in the case of the drive unit 41 shown in FIG. 14. When the lever 182 is swung from a position shown in FIG. 17 to another position shown in FIG. 19, the first teeth section 118 of the rack 46 is released from the drive gear 116 while the second teeth section 119 thereof is toothed with the manual gear 162.

Figure 20:
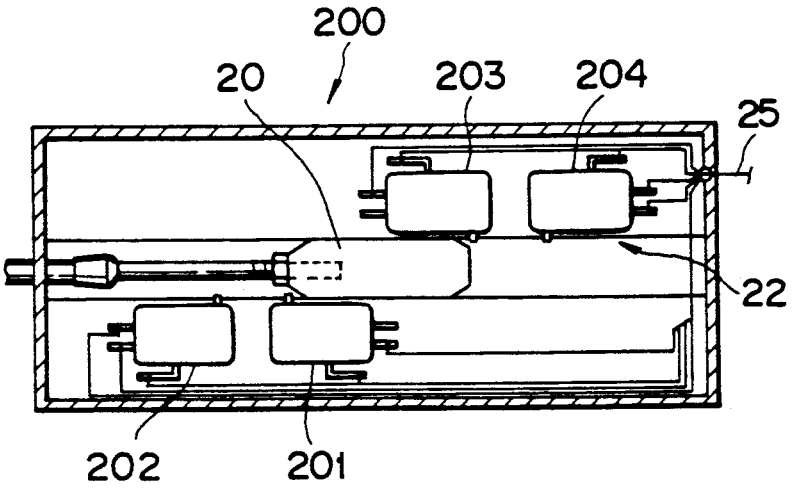
FIG. 20 is a front view showing a variation of the primary sensor in a sensor unit.
Figure 22:
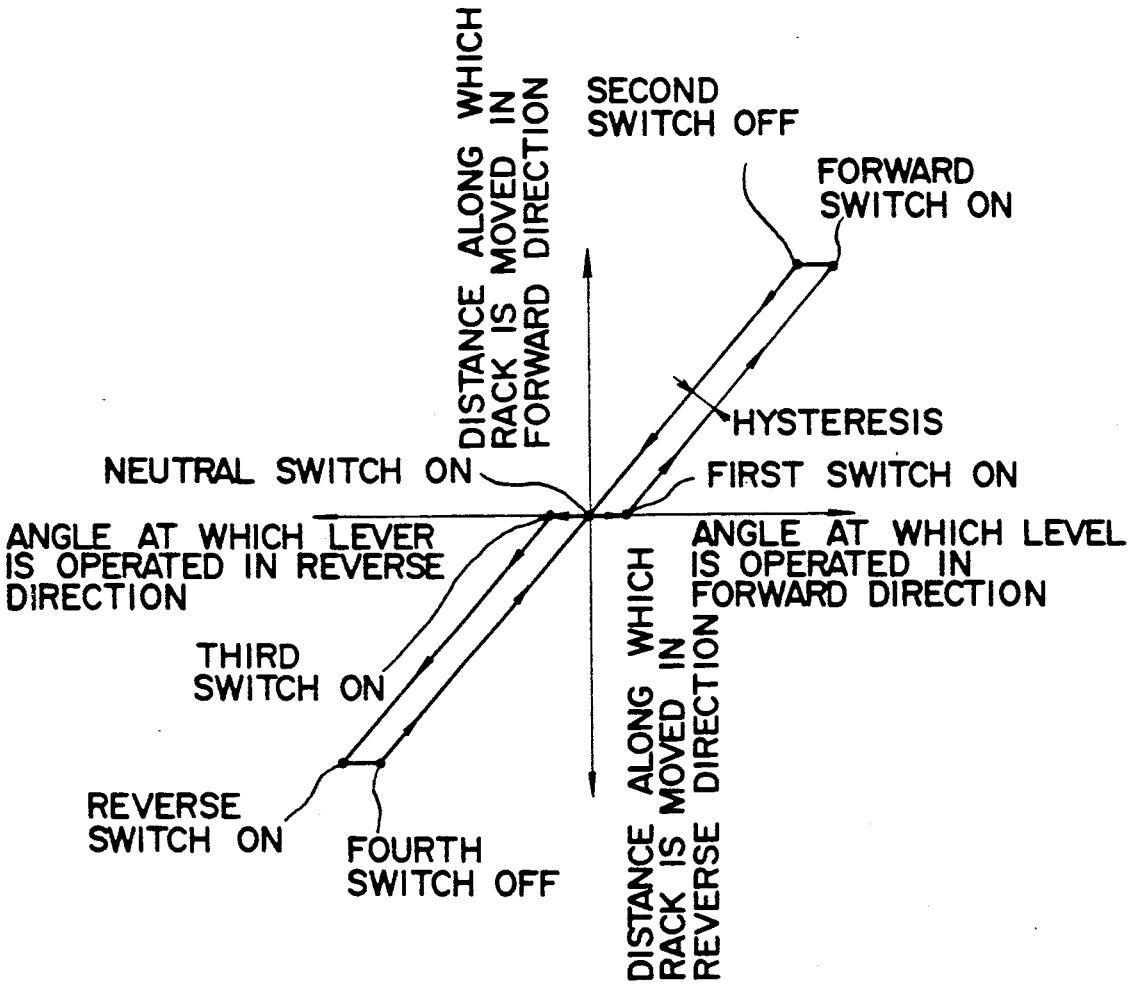
FIG. 22 shows a relation between angles at which the operation lever is operated and distances along which the movable rack is moved in a case where the sensors shown in FIGS. 20 and 21 are employed.

In the case of a sensor unit 200 shown in FIG. 20, first, second, third and fourth micro-switches 201, 202, 203 and 204 are used as the primary sensor 22. In the case of a drive unit 41' shown in FIG. 21, three micro-switches 210, 211 and 212 are used as the secondary sensor 48. An arm 220 is attached to the movable rack 46. When the movable rack 46 is in shift forward position, the forward switch 210 is turned on. When the movable rack 46 is in shift reverse position, the reverse switch 211 is turned on. When the movable rack 46 is in neutral position, the neutral switch 212 is turned on. When shift operations are executed by the operation levers 16 in the case where the micro-switches 201–204 and 210–212 are used, the movable rack 46 is moved, creating hysteresis to some extent, as shown in FIG. 22.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An engine control device for connecting a remote control box having an operation lever to a controlled section of an engine, comprising:

a moving element associating with the operation lever;

a primary sensor for creating electric signals in response to positions of the moving element;

a force transmitting member having a drive and driven ends and the driven end being connected to the controlled section of the engine;

a drive unit for driving the force transmitting member and including an electric motor rotatable forward and backward, a worm gear system driven by the motor and provided with a drive gear, a movable rack connected to the drive end of the force transmitting member and driven by the drive gear, and a secondary sensor for creating electric signals in response to positions of the movable rack; and a control circuit for controlling the motors to be started and stopped and serving to compare the position of the moving element detected by the primary sensor with that of the movable rack detected by the secondary sensor to drive the motor in such a direction as to eliminate a mutual displacement of these two components.

2. The engine control device according to claim 1, wherein said force transmitting member is a push-pull cable.

3. The engine control device according to claim 1, wherein potentiometers are used as said primary and secondary sensors.

4. The engine control device according to claim 1, wherein micro-switches are used as said primary and secondary sensors.

5. The engine control device according to claim 1, wherein said movable rack in the drive unit has first and second teeth sections and it can move between a first position where its first teeth section is toothed with the drive gear and a second position where its first teeth section is released from the drive gear, and said drive unit includes rack position changeover system for selectively holding the movable rack at either first or second position, a manual gear toothed with the second teeth section of the movable rack when this rack is moved to the second position, and a handle for rotating the manual handle.

6. The engine control device according to claim 5, wherein said drive unit includes a guide member supported freely rockable, and this guide member is passed through a through-hole extending in the movable rack along the axial line of the rack.

7. An engine control device for connecting plural control boxes each having an operation lever to a controlled section of an engine, comprising:

moving elements associating with the operation levers;

primary sensors for creating electric signals in response to positions of the moving elements;

a force transmitting member having drive and driven ends and this driven end thereof being connected to the controlled section of the engine;

a drive unit for driving the force transmitting member and including an electric motor rotatable forward and backward, a worm gear system driven by the motor and provided with a drive gear, a movable rack connected to the drive end of the force transmitting member and driven by the drive gear, and a secondary sensor for creating electric signals in response to positions of the movable rack;

selection switches each being turned on to select its corresponding one of the plural control boxes which is to be used; and a control circuit serving to control the motors to be started and stopped and including a) a program for comparing the position of the moving element detected by the primary sensor with that of the movable rack detected by the secondary sensor to drive the motor in such a direction as to eliminate a mutual displacement of these two components;

b) a program for allowing changeover to control box to be made only if both of the moving element of the control box which is under operation mode and of the movable rack in the drive unit are in predetermined positions and the moving element of the control box which is to be changed over is in a predetermined position at the time when that selection switch which corresponds to the control box to be changed over is turned on;

c) a timer for counting the time lapsing from when the rotation of the motor in the drive unit is started;

d) a program for executing retrying operation to temporarily stop the supply of current to the motor and then again supply current to the motor in a case where the position of the moving element does not coincide with that of the movable rack even if the timer reaches a predetermined time period; and e) a program for driving the motor to return the movable rack to its original position while creating alarm when the position of the moving element does not coincide with that of the movable rack even after the retrying operation is executed.

8. An engine control device for connecting plural control boxes each having an operation lever to shift and throttle systems of an engine, comprising:

moving elements associating with the operation levers;

primary sensors for creating shift controlling electric signals in response to positions of the moving elements;

primary sensors for creating throttle controlling electric signals in response to positions of the moving elements;

a shift force transmitting member having drive and driven ends and this driven end thereof being connected to the shift system of the engine;

a shift drive unit for driving the shift force transmitting member and including a reversible electric motor, a worm gear system having a drive gear driven by the motor, a movable shift rack connected to the drive end of the shift force transmitting member and driven by the drive gear, and a secondary shift sensor for creating electric signals in response to the position of the movable rack;

a throttle force transmitting member having drive and driven ends and this driven end thereof being connected to the throttle system of the engine;

a throttle drive unit for driving the throttle force transmitting member and including a reversible electric motor, a worm gear system having a drive gear driven by the motor, a movable throttle rack connected to the drive end of the throttle force transmitting member and driven by the drive gear, and a secondary throttle sensor for creating electric signals in response to the position of the movable rack;

selection switches each being turned on to select its corresponding one of the plural control boxes which is to be used; and a control circuit serving to control the motors in the shift and throttle drive units to be started and stopped and including a) a program for comparing the position of the moving element detected by the primary sensor with that of the movable shift rack detected by the secondary sensor to drive the motor in the shift drive unit in such a direction as to eliminate a mutual displacement of these two components;

b) a program for allowing changeover to a control box to be made only if both of the moving element of the control box which is under operation mode and of the movable rack in the shift drive unit are in neutral position and the moving element of the control box which is to be selected is also in neutral position at the time when the selection switch which corresponds to the control box to be selected is turned on;

c) a shift timer for counting the time lapsing from when the rotation of the motor in the shift drive unit is started;

d) a program for executing retrying operation to temporarily stop the supply of current to the motor and then again supply current to the motor in a case where the position of the moving element does not coincide with that of the movable shift rack even if the timer reaches a predetermined time period;

e) a program for driving the motor to return the movable rack to its original position while creating alarm when the position of the moving element does not coincide with that of the movable shift rack even after the retrying operation is executed;

f) a program for comparing the position of the moving element detected by the primary sensor with that of the movable throttle rack detected by the secondary sensor to drive the motor in the throttle drive unit in such a direction as to eliminate a mutual displacement of these two components; and g) a program for making the shift drive unit operative only when the throttle drive unit is in idling position and making the throttle drive unit operative only when the shift drive unit is in either of forward, neutral or reverse position.

9. The engine control device according to claim 8, wherein the control circuit includes a program for resetting the shift timer when the operation lever is moved from shift forward to reverse via neutral or vice versa.

10. The engine control device according to claim 8, wherein the control circuit includes a throttle timer for counting the time lapsing from when the rotation of the motor in the throttle drive unit is started, and a program for rotating the motor in the throttle drive unit to return the movable throttle rack to the idling position while creating alarm when the position of the moving element does not coincide with that of the movable throttle rack even when the timer reaches a predetermined time period.

11. The engine control device according to claim 8, wherein the control circuit is connected to the control boxes by electric cables and the control circuit includes a program for driving the motor to return the movable shift rack in the shift drive unit to neutral position while driving the motor to return the movable throttle rack in the throttle drive unit to idling position when the cables have something wrong.

* * * * *